US007337741B1

(12) United States Patent
Ansay et al.

(10) Patent No.: US 7,337,741 B1
(45) Date of Patent: Mar. 4, 2008

(54) PRE-POSITIONING DEPLOYMENT SYSTEM FOR SMALL UNMANNED UNDERWATER VEHICLES

(75) Inventors: Michael T. Ansay, Narragansett, RI (US); Angelo Di Biasio, Saunderstown, RI (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 323 days.

(21) Appl. No.: 11/240,778

(22) Filed: Sep. 28, 2005

Related U.S. Application Data

(60) Provisional application No. 60/656,550, filed on Feb. 18, 2005.

(51) Int. Cl.
*B63B 1/00* (2006.01)

(52) U.S. Cl. ..... 114/239; 89/1.81; 89/1.809

(58) Field of Classification Search ..... 114/238, 114/239; 89/1.81, 1.809, 1.816; 102/411
See application file for complete search history.

(56) References Cited

U.S. PATENT DOCUMENTS 4,003,291 A 1/1977 Vass et al.
4,263,835 A 4/1981 Dragonuk
5,170,005 A 12/1992 Mabry et al.
5,542,333 A 8/1996 Hagelberg et al.
5,660,135 A * 8/1997 Gomes et al. ..... 114/312
6,376,762 B1 * 4/2002 French et al. ..... 114/22
6,484,618 B1 11/2002 Dubois
6,487,952 B1 12/2002 Borgwarth et al.
6,854,410 B1 * 2/2005 King et al. ..... 114/244

* cited by examiner

*Primary Examiner*—Michael J. Carone
*Assistant Examiner*—Gabriel J Klein
(74) *Attorney, Agent, or Firm*—James M. Kasischke; Michael P. Stanley; Jean-Paul A. Nasser

(57) ABSTRACT

A system is disclosed for pre-positioning a canister assembly at an undersea location. A transporter deploys to and releases the assembly proximate to the desired location. Once the assembly has fallen a safe distance after release, spring bands of the assembly are released by the action of lanyards of the transporter. The release allows anchor plates on each end of the assembly to separate from the assembly thereby dragging the assembly to a seafloor with the assembly buoyant at the undersea location. A vehicle deployment from the assembly is actuated by an acoustic receiver that causes a release device to release a normally compressed spring thereby allowing the spring to expand. During expansion, water is drawn into the assembly through flow ports to force a plunger plate with the water to act on a vehicle to deploy the vehicle out of a deployment tube of the assembly.

13 Claims, 12 Drawing Sheets

PRE-POSITIONING DEPLOYMENT SYSTEM FOR SMALL UNMANNED UNDERWATER VEHICLES

This application claims the benefit of U.S. Provisional Application Ser. No. 60/656,550, filed Feb. 18, 2005.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention relates to deployment systems with the ability to pre-position weapons, small vehicles, or sensors within undersea littoral environments.

(2) Description of the Prior Art

Launching from underwater sites is particularly important for torpedoes, sensors and other types of undersea vehicles. Such vehicles have a short range, and if they are to be successful, it is important that they be launched to begin their run on a target immediately following detection of a target in the area. Therefore a need exists to provide a device to populate ports with various sensors, vehicles, or weapons such that any submarine traffic leaving the port could be covertly monitored or disrupted over extended periods of time. A further need exists to provide a device from which track and trail vehicles could be released to follow submarines or other vessels leaving a port A number of prior art systems are known which relate to the launching or release of vehicles from undersea positions. In Vass et al. (U.S. Pat. No. 4,003,291), an underwater multiple missile launcher is disclosed which comprises a main case having a pair of launcher platforms. Each platform has a transducer column and a plurality of missiles pivotally mounted on the platform in a circular array around the transducer columns.

In Dragonuk (U.S. Pat. No. 4,263,835), the reference discloses a pneumatic restraint and ejection system for a multiple sonobuoy launcher having a single plenum communicating through separate check valves to the inboard ends of a plurality of launcher tubes and through separate girdle valves to inflatable girdles about the launch tubes. A sonobuoy is ejected by actuating the girdle valve to shut off the plenum air to the girdle and to exhaust the air in the girdle.

In Mabry et al. (U.S. Pat. No. 5,170,005), the reference discloses an underwater launch system for launching a rocket which includes a capsule for containing the rocket, the capsule being buoyant. Upon command, the capsule rises to the ocean surface where the rocket is automatically launched.

In Hagelberg et al. (U.S. Pat. No. 5,542,333), the reference discloses an upright or horizontal capsule in which the vehicle is placed.

In Dubois (U.S. Pat. No. 6,484,618), the reference discloses a marine countermeasure launch assembly in which multiple countermeasures are released into the water by separation of the launch assembly.

In Borgwarth et al. (U.S. Pat. No. 6,487,952), the reference discloses a remote fire support system that remains beneath the water's surface until it is to be launched. At the desired activation time, weights attached to the container of the system are released and the container rises to the surface for launching.

While the above references disclose types of launch systems, none of the existing references utilize a coil spring for launch energy as a linear launch force. Further, none of the existing references utilize a plunger assembly and pressurized seawater for vehicle deployment. Still further, none of the existing references disclose the use of an arrangement of anchor plates, anchor lines and canister buoyancy to safely launch, deploy and control an entire canister. Still further, none of the existing patents allow for vehicle deployment at both ends of the deployment canister.

Also, none of the cited references make use of a check valve to reduce frictional losses as the vehicle is being deployed. Further, none of the cited references uses a watertight bag to contain the vehicle in which the watertight bag is filled with an inert fluid to prevent the vehicle from corroding.

Still further, none of the cited references allow for pressure equalization around the vehicle. Instead many of them utilize a pressure-proof container thereby requiring a more robust container.

SUMMARY OF THE INVENTION

As a result of (but not exhaustive of) the shortcomings of the references cited above, it is therefore an objective and general purpose of the present invention to provide an improved deployment system including a device to populate ports with various sensors, vehicles, or weapons such that any submarine traffic leaving the port could be covertly monitored or disrupted over extended periods of time.

It is therefore a further object of the present invention to provide an improved device from which track and trail vehicles could be released to follow submarines or other vessels leaving a port.

In order to obtain the objects described above, there is provided a deployment system for an undersea environment in which the deployment system comprises a transporter (such as a UUV) having a quick release device and lanyards.

The transporter releases a canister assembly secured to the quick release device. The canister assembly includes spring bands encompassing a circumference of the canister assembly and secured to the transporter by the lanyards with the canister assembly further including anchor plates secured to a first and second end of the canister assembly by at least one anchor line and the spring bands. The quick release device and the lanyards are capable of releasing the canister assembly upon the deployment at an extent of the lanyards such that the spring bands separate to release the anchor plates from the ends of the canister assembly to position the anchor plates on a surface of the undersea environment thereby positioning the canister assembly by the securing the at least one anchor line.

The canister assembly is capable of stowing at least one vehicle and comprises a signal receiver, the signal receiver operationally controllable of the at least one vehicle such that upon detection of an acoustic signal the signal receiver initiates the release of a vehicle from either the first end or the second end of the canister assembly. The canister assembly further comprises at least one deployment tube wherein the one least one deployment tube includes a release device controllable by the signal receiver; a cord releasably secured at one end to the release device; a plunger plate positioned transverse to a longitudinal axis of the deployment tube and secured at another end of the cord, the plunger plate movable along the longitudinal axis; and a spring positioned between the plunger plate and the release device. The signal receiver initiates the release of the vehicle from the deployment tube and the canister assembly by actuating the release device to release the cord thereby allowing the spring to uncoil with a resultant energy on the plunger plate to move against the vehicle to exit from the deployment tube and the canister assembly.

The deployment tube further includes a plurality of flow ports through a periphery of the deployment tube, the flow ports capable of drawing water from the undersea environment into the deployment tube thereby pressuring the vehicle in combination with the plunger plate to exit the canister assembly.

As such, the present invention provides a device from which track and trail vehicles can be released to follow submarines or other vessels leaving a port.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
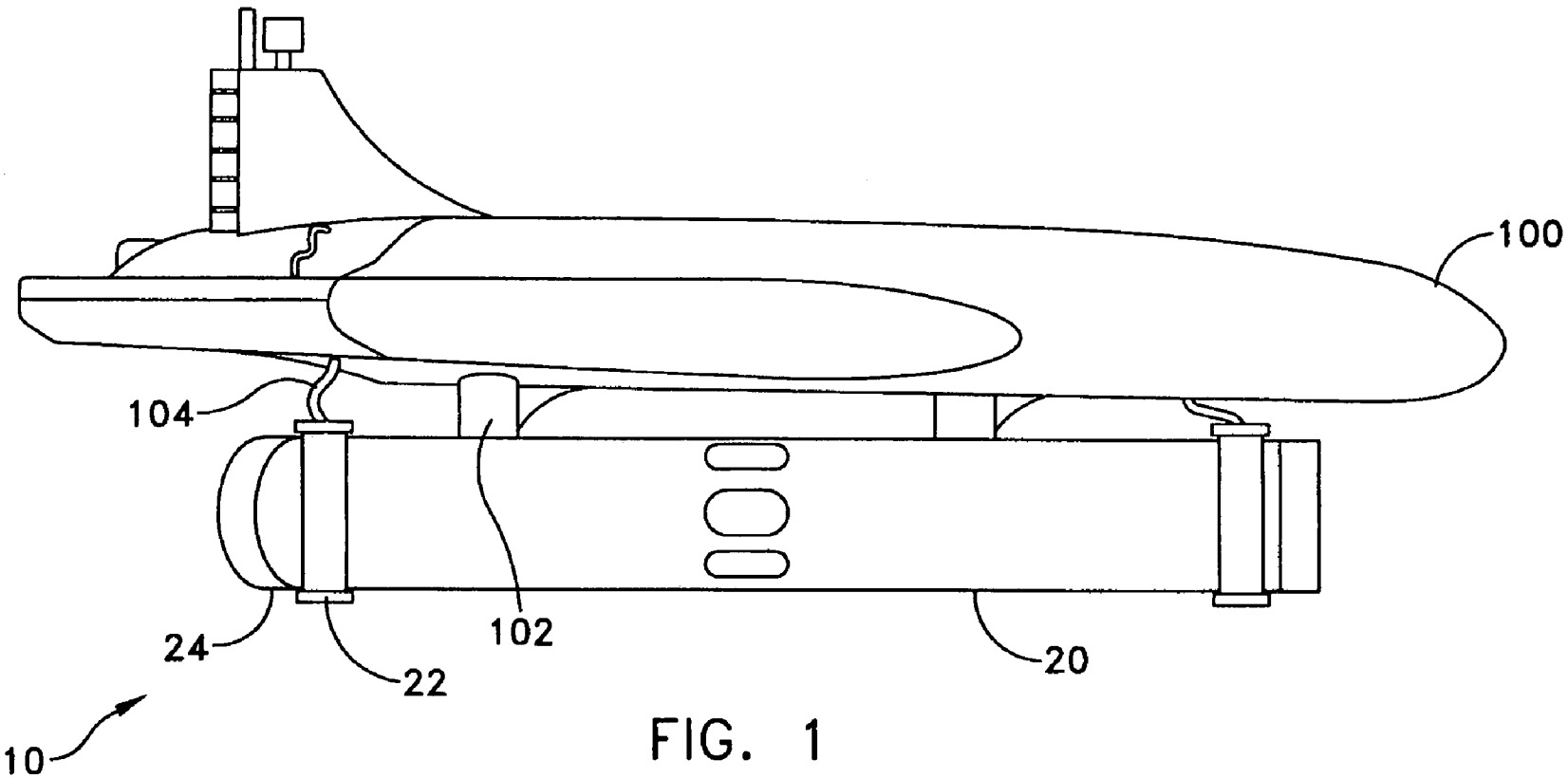
FIG. 1 depicts a configuration of the present invention with a canister assembly secured to a delivery vehicle for the canister assembly.
Figure 2:
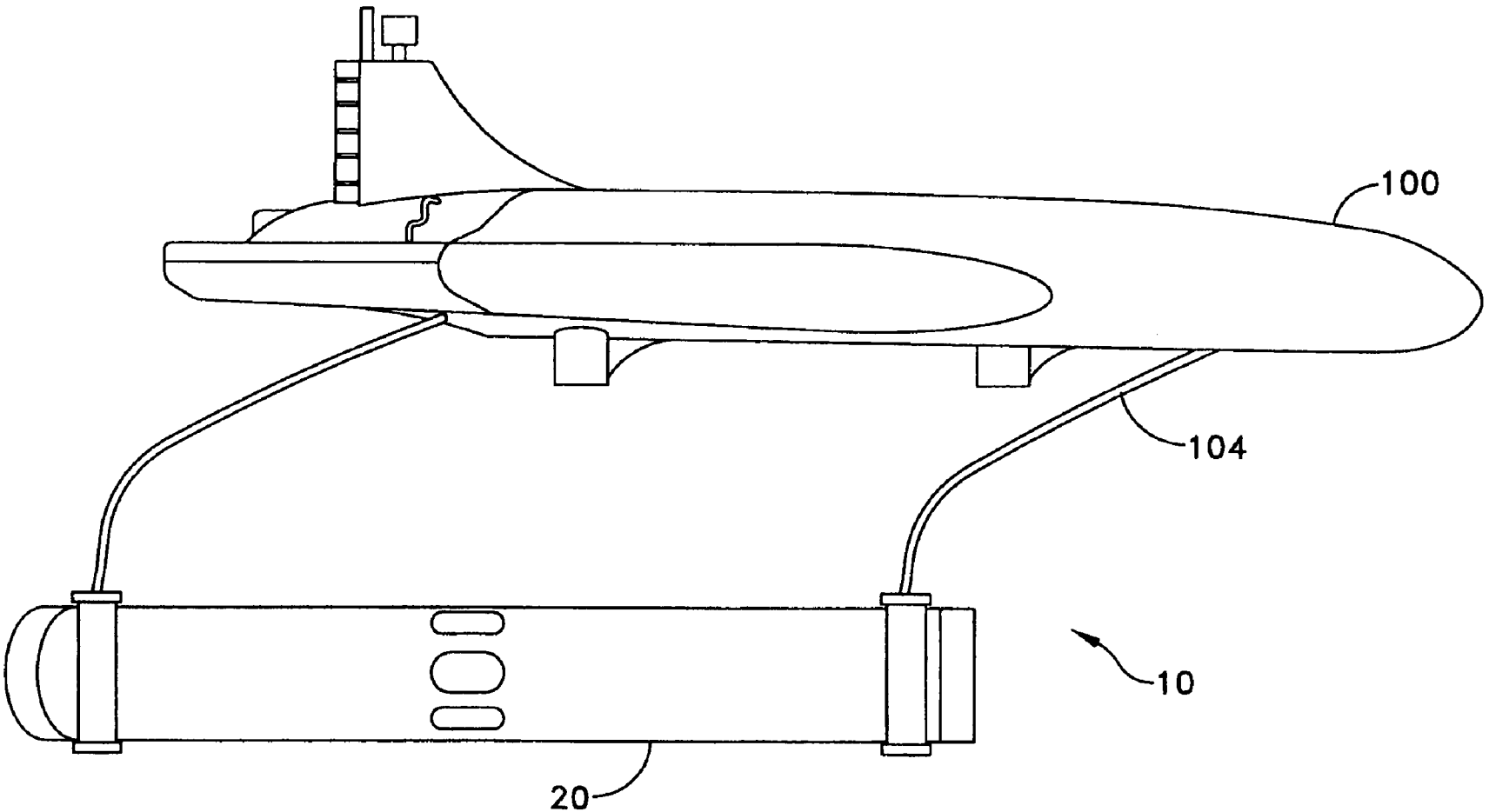
FIG. 2 depicts a configuration of the present invention with the canister assembly secured to the delivery vehicle with the canister assembly being deployed.
Figure 3:
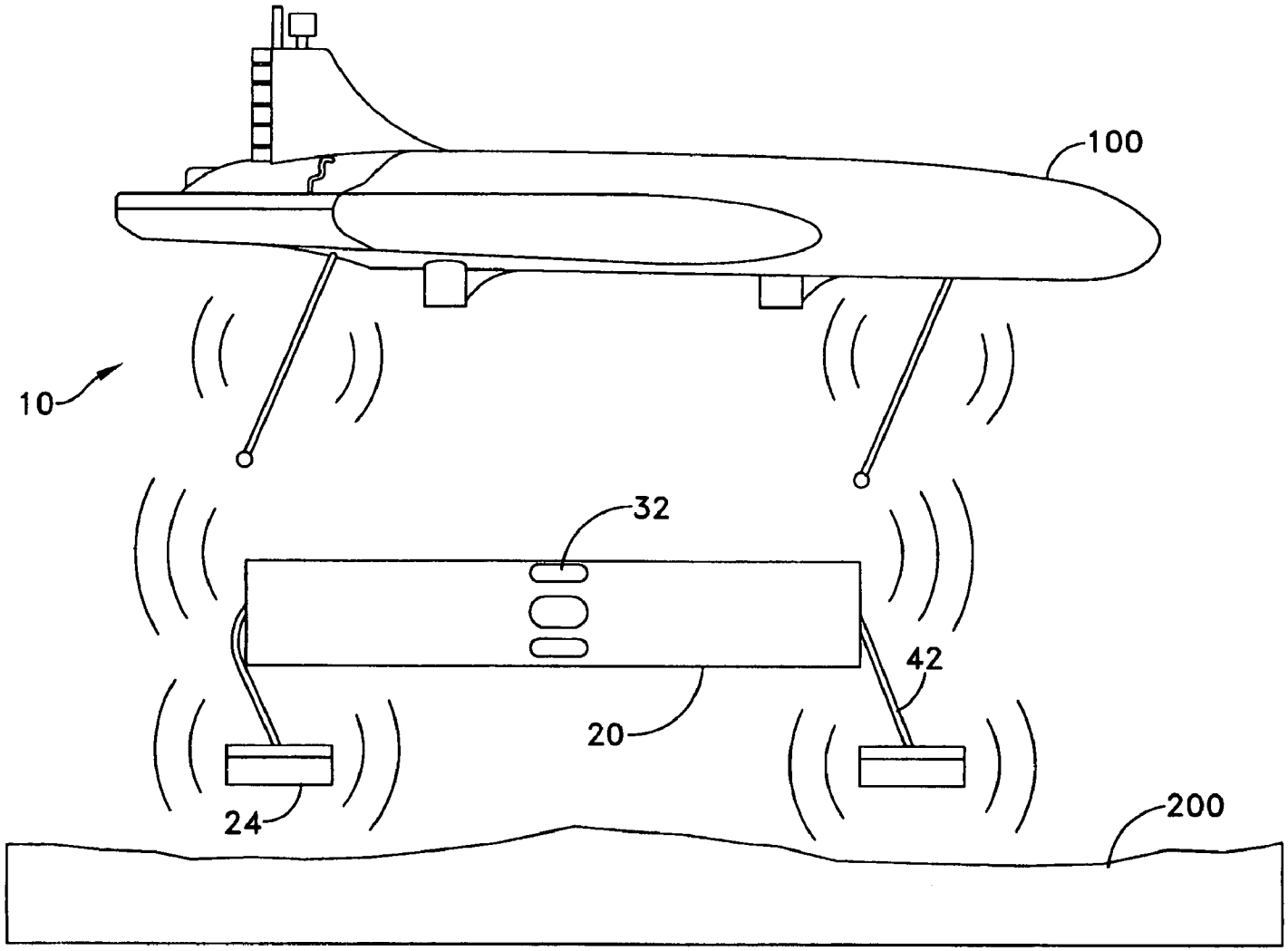
FIG. 3 depicts a configuration of the present invention with the canister assembly released from the delivery vehicle with the canister assembly being deployed.
Figure 4:
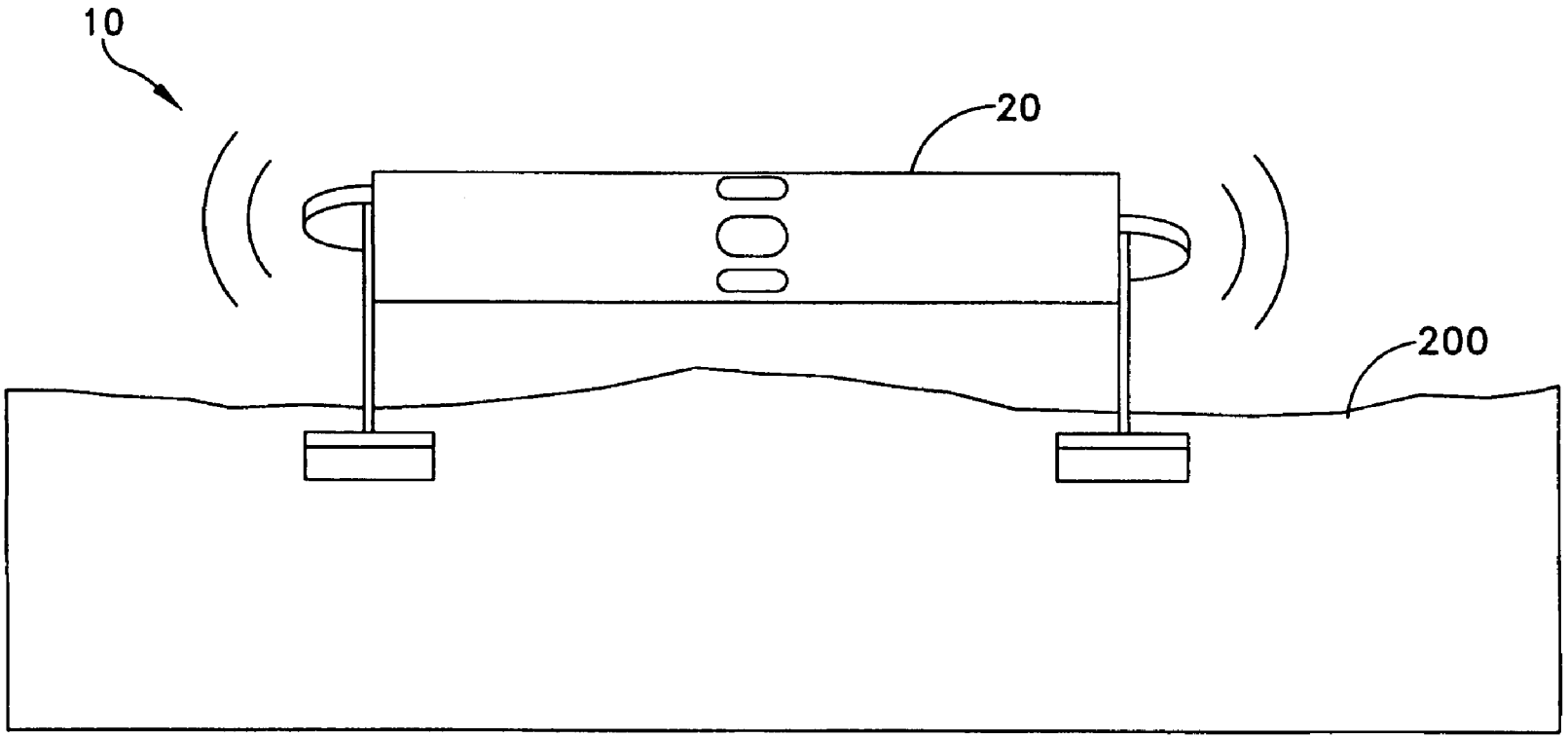
FIG. 4 depicts the canister assembly of the present invention anchored to a seabed of an undersea environment.
Figure 5:
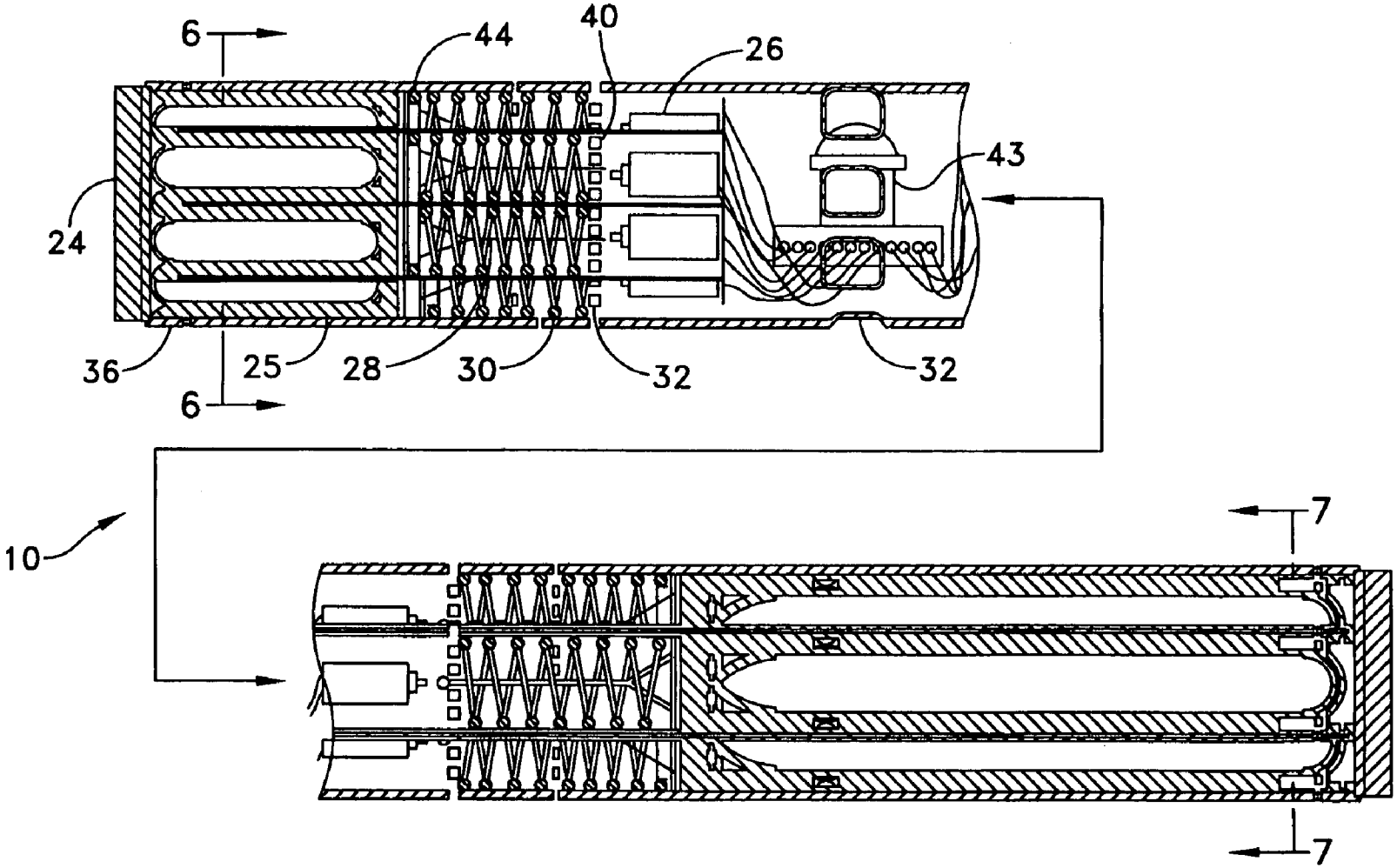
FIG. 5 is a cross-sectional view of the canister assembly of the present invention.

As shown in FIGS. 1-4, the deployment system 10 of the present invention allows the pre-positioning of a canister assembly 20 at a tactical location in a littoral environment. In general, when the canister assembly 20 is deployed by a transporter such as a large UUV 100 shown, it is covertly delivered to a desired pre-positioning location. Once at the pre-positioning location, the UUV 100 signals a linear actuator to trigger quick release devices 102 of the UUV. The canister assembly 20 then falls away from the UUV 100. Once the canister assembly 20 has fallen a safe distance that is equal to the length of retractable lanyards 104 of the UUV 100, two spring bands 22 of the canister assembly are released. The release of the spring bands 22 allows anchor plates 24 on each end of the canister assembly 20 to separate and fall away from the canister assembly. The anchor plates 24 then drag the buoyant canister assembly 20 to a seafloor 200 for final positioning. The canister assembly 20 then remains camouflaged and dormant until a vehicle deployment from the canister assembly is called for.

A sequence of how the deployment system 10 would be utilized, once deployed, is as follows in regard to FIGS. 5 thru 13. Once it is known that the submarine (not shown) is sufficiently close to the deployment system 10, a remote acoustic signal triggers the release of a vehicle 25 for tagging the submarine. The acoustic signal causes a release device 26 to activate and release a cord 28 that normally secures a compressed spring 30. After release, the spring 30 is then free to expand. As the spring 30 expands, it draws water in through flow ports 32 and expands the spring, along with the vehicle 25, out of a muzzle end 36 of a deployment tube 40. A muzzle cap 41 is pushed off in the process, and a vehicle start-up switch is initiated. At this point, the vehicle 25 is free to seek out and tag the nearby submarine.

Referring again to FIGS. 1 thru 4, the quick release devices 102 are used to support the weight of the canister assembly 20 underneath the large UUV 100 during transit to the pre-positioning location. Once the large UUV 100 reaches the designated pre-positioning location, a linear actuator shall pull a cord attached to the quick release devices 102 to activate the quick release devices at the same time. In this way, the canister assembly 20 is released such that the canister assembly falls away from the large UUV 100 in a generally straight and level fashion.

The retractable lanyards 104 are used to separate the anchor plates 24 from each end of the canister assembly 20 once the canister assembly has fallen a safe distance from the large UUV 100. Once the lanyards 104 have reached the end of their length, the lanyards pull a safety clip (not shown) off the spring bands 22. The spring bands 22 release the anchor plates 24 and allow the anchor plates to separate from the canister assembly 20. Once the safety clip is removed, the lanyards 104 shall retract back into their respective housings to avoid entanglement with the propulsion system of the large UUV 100.

More specifically, the spring bands 22 are used to connect the anchor plates 24 to the canister assembly 20 until the entire assembly is deployed. The spring bands 22 are secured using a safety clip and lock. The spring bands 22 are locked in place when the canister assembly 20 is assembled. The locks remain in place while the canister assembly 20 is being handled and loaded underneath the large UUV 100. The locks are removed after the canister assembly 20 is prepared for final deployment.

At that point, only the safety clips prevent the spring bands 22 from releasing. The lanyards 104 remove the safety clips once the canister assembly 20 has fallen a safe distance from the large UUV 100. The spring bands 22 then release and allow the anchor plates 24 to separate from the canister assembly 20. The spring bands 22 remain attached to the anchor plates 24.

The anchor plates 24 are used as shock mitigation devices and as protective covers for each end of the canister assembly 20. As a protective cover, the anchor plates 24 protect the vehicles 25 inside the canister assembly 20 from accidentally sliding out during handling and loading. The anchor plates 24 contain the vehicles 25 during all other times leading up to the actual deployment.

Once the anchor plates 24 are released, the canister assembly 20 is in full descent. The anchor plates 24 remain attached to the canister assembly 20 by anchor lines 42. The anchor plates 24 shall be negatively buoyant, while the remaining canister assembly 20 is positively buoyant. Furthermore, the anchor plates 24 shall be more negatively buoyant than the canister assembly 20 is positively buoyant. As a result, the buoyant canister assembly 20 is actually pulled to the seafloor by the greater in-water weight of the anchor plates 24. The anchor plates 24 absorb the shock of impacting the seafloor while sparing the canister assembly 20. As soon as the anchor plates 24 hit, the canister assembly 20 begins to reverse its direction. However, the momentum of the canister assembly 20 will continue to carry the canister assembly downward for a short time until the canister assembly actually completes the reversing process.

The shape of the canister assembly 20 may vary but is envisioned to be cylindrical for delivery from a submarine torpedo tube and because a cylindrical shape has a hydrodynamic shape for low drag. The canister assembly 20 has several of the flow ports 32, which are large in size, located near the center of the canister assembly. The flow ports 32 allow water to be drawn in during a launch of the vehicle 25, and allow for a direct water transmission path to an acoustic receiver 43 inside of the canister assembly 20.

In further description of the structure of the canister assembly 20, the ends of the canister assembly are closed off with the anchor plates 24. At key positions, internal support frames 44 reinforce the structural shape of the canister assembly 20. The length and interior configuration of the canister assembly 20 accommodates vehicle launchings from both ends of the canister assembly.

As shown in FIGS. 8 thru 13, an individual deployment tube 40 shall contain the vehicle 25 that are to be deployed. Each of the deployment tubes 40 structurally include a plunger plate 45, a seal and constraint ring 46, and check valve 47, the spring 30, and the release device 26. The total number of deployment tubes 40 is dependent on the size of the canister assembly 20 and on the size of the items to be deployed.

Each of the deployment tubes 40 also contains two sets of water flow ports 32. The first set of flow ports 32 is positioned to be near the nose of the vehicle 25. The first set of flow ports 32 allows water to flood the volume of space inside the deployment tube 40 forward of the seal and constraint ring 46.

A second set of flow ports 32 is located just forward of the check valve 47 when the spring 30 is in the compressed state. The second set of flow ports 32 allow water to flood the volume between the plunger plate 45 and the constraint ring 46 and are blocked off behind the plunger plate as soon as the plunger plate begins to traverse down the deployment tube 40. This movement ensures that the water is forced forward, behind the deploying vehicle 25, instead of being forced back out through the flood ports 32. This movement of the water causes the vehicle 25 to be flushed out of the deployment tube 40.

The third set of flow ports 32 is positioned behind the spring 30 and forward of the release device 26. The third set of flow ports 32 allow water to flow in behind the plunger plate 45, as it traverses down the deployment tube 40. The third set of flow ports 32 also allow for an uninterrupted signal transmission path to the acoustic receiver 43.

An individual deployment tube 40 also contains a shoulder stop 52. The shoulder stop 52 positions the spring 30 and supports a fixed end of the spring 30 during compression of the spring.

One spring 30 is preferred per individual deployment tube 40. The spring 30 stores potential energy that is used to eject the vehicle 25 from the deployment tube 40. The spring 30 is compressed by the release device 26 via the cord 28 until a launch is initiated.

The spring 30 contains sufficient stored energy to overcome several opposing forces such as: the force required to push off the nose cap; the frictional forces associated with guide rails 54 of the deployment tube 40, the plunger plate 45, and the ring 46; and the fluid losses associated with pumping water through the deployment tube 40. The stiffness of the spring 30 is sized to overcome these forces. The length of the spring 30 is sufficiently long to either completely eject the vehicle 25 from the deployment tube 40 or impart enough energy on the vehicle so its own momentum is enough to carry it out of the deployment tube.

The release device 26 initiates the deployment of the vehicle 25. In a pre-deployment state, the release device 26 holds the spring 30 in a compressed state. For deployment, the release device 26 activates a remote acoustic signal. Once activated, the release device 26 mechanically releases the cord 28 connected to the check valve 47. Once the cord 28 is released, the plunger plate 44 traverses forward while ejecting the vehicle 25 in the process.

The acoustic receiver 43, attached and wired into the release device 26, is used to detect a remote acoustic signal from any acoustic source. Once the acoustic signal is received, the acoustic receiver 43 transmits the signal to the internal electronics of the release device 26. A motor controller of the release device 26 then opens a latch 56 that secures the cord 28. The acoustic receiver 43 shall have various coded release messages to prevent the deployment system 10 from being accidentally triggered and allows for the release of specific vehicles. The release device 26 and acoustic receiver 43 are optimally one component, in which the component is of a type known by those skilled in the art.

Figure 8:
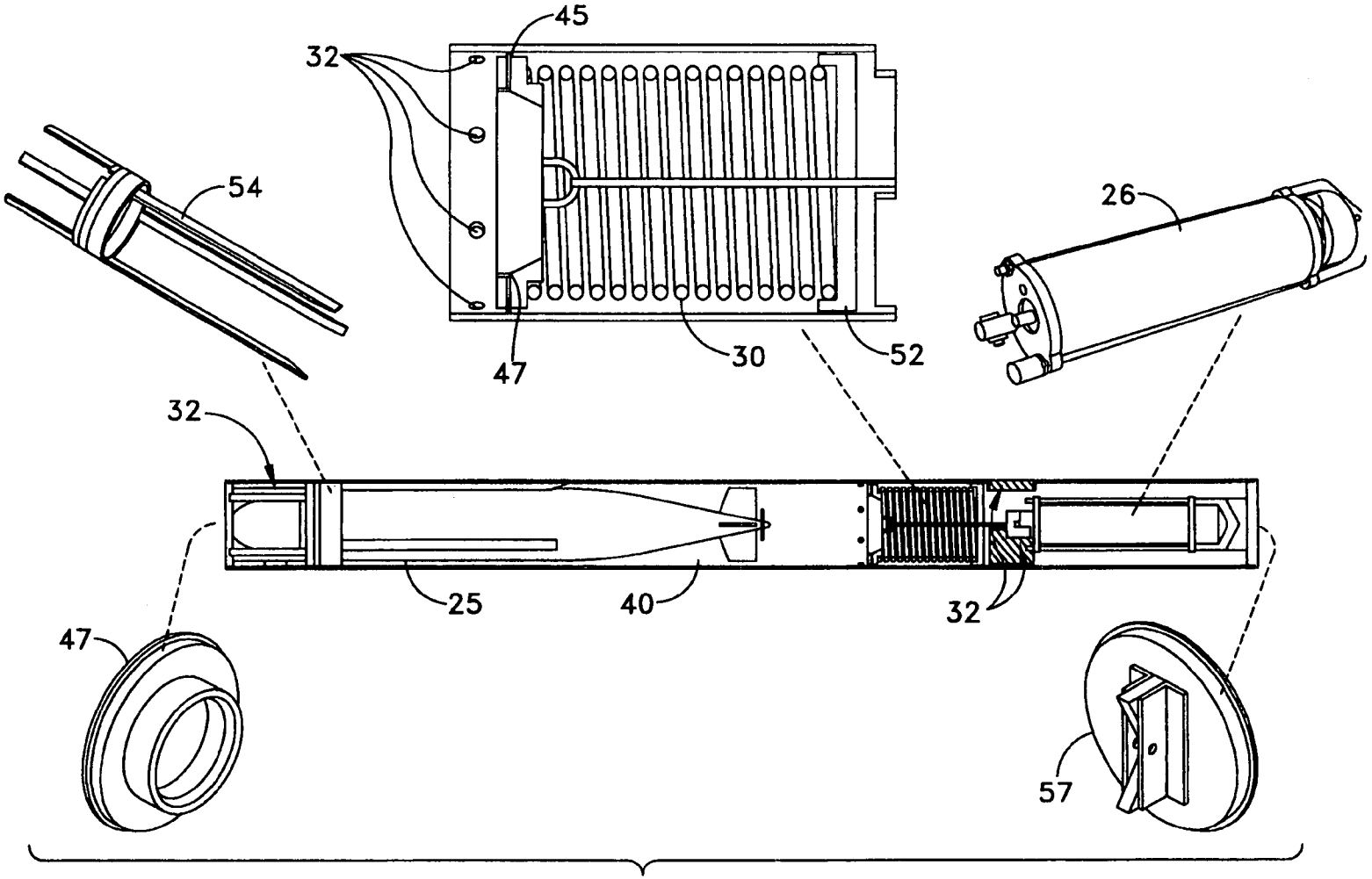
FIG. 8 is a cross-sectional view of the deployment tube of the present invention.
Figure 9:
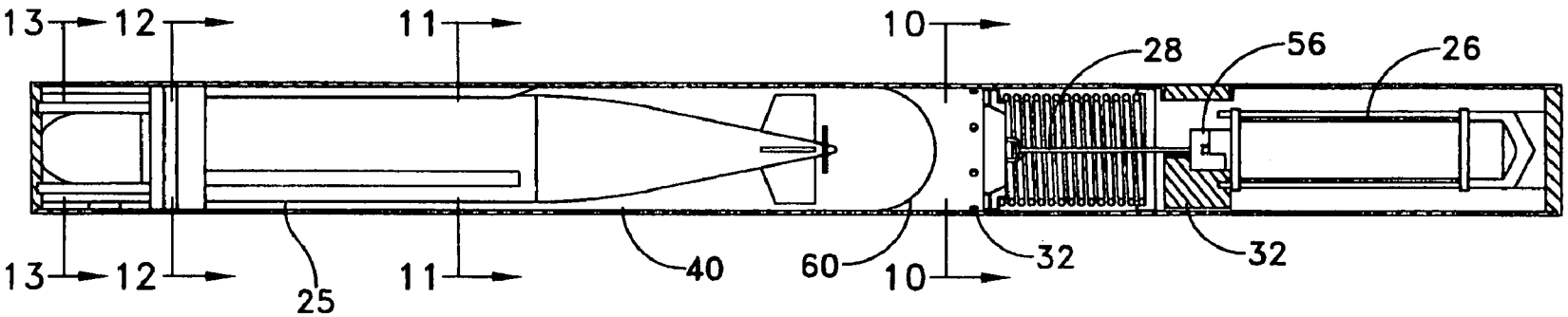
FIG. 9 is an additional cross-sectional view of the deployment tube of the present invention.
Figure 10:
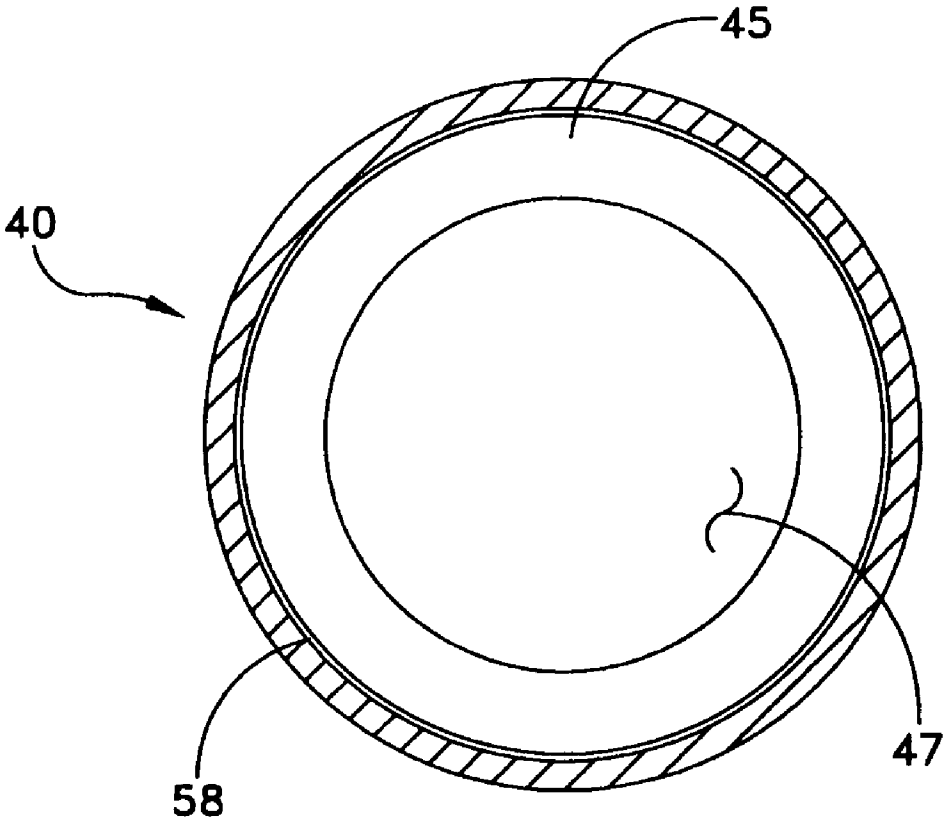
FIG. 10 is an alternate cross-sectional view of the deployment tube of the present invention specifically depicting the plunger plate and check valve of the deployment tube with the view taken from reference line 10-10 of FIG. 9.
Figure 11:
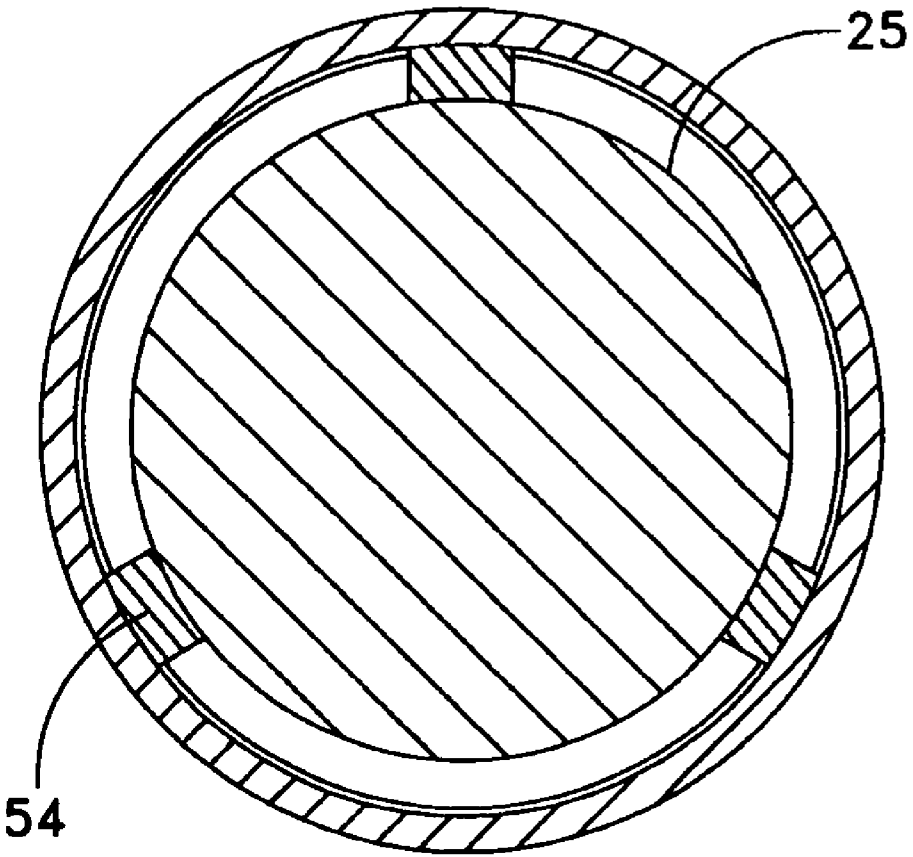
FIG. 11 is an alternate cross-sectional view of the deployment tube of the present invention specifically depicting the aft guide rails of the deployment tube with the view taken from reference line 11-11 of FIG. 9.
Figure 12:
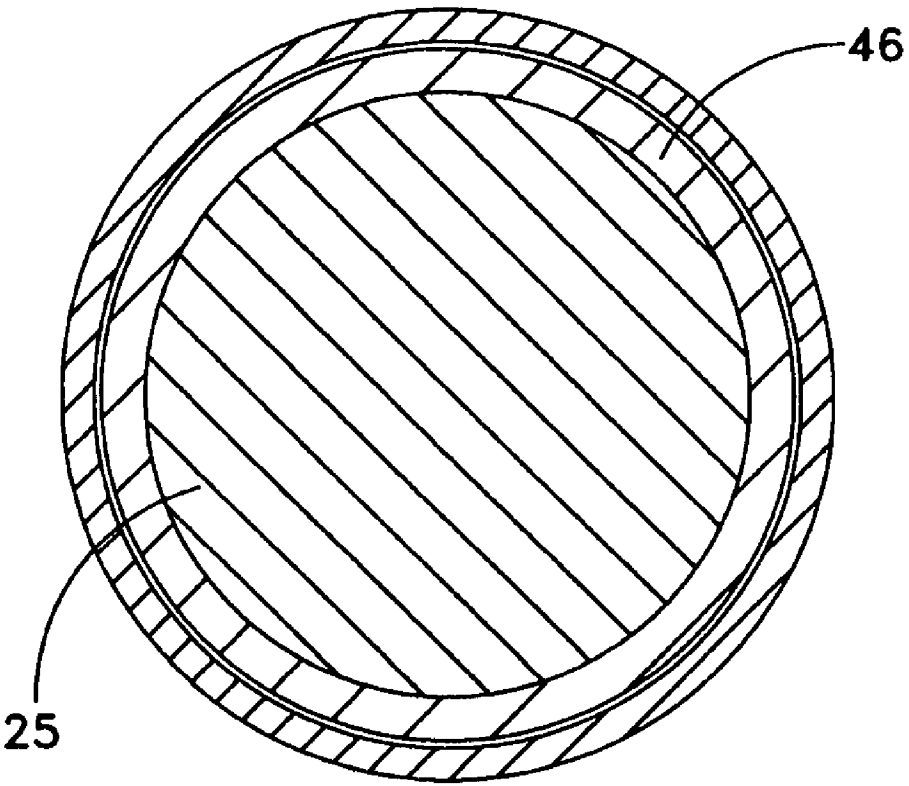
FIG. 12 is an alternate cross-sectional view of the deployment tube of the present invention specifically depicting the seal and constraint ring of the deployment tube with the view taken from reference line 12-12 of FIG. 9.

The end cap/release restraint assembly 57 as seen in FIG. 8 is a fixture that secures the release device 26 and acoustic receiver 43 to the aft end of the individual deployment tube 40.

Figure 7:
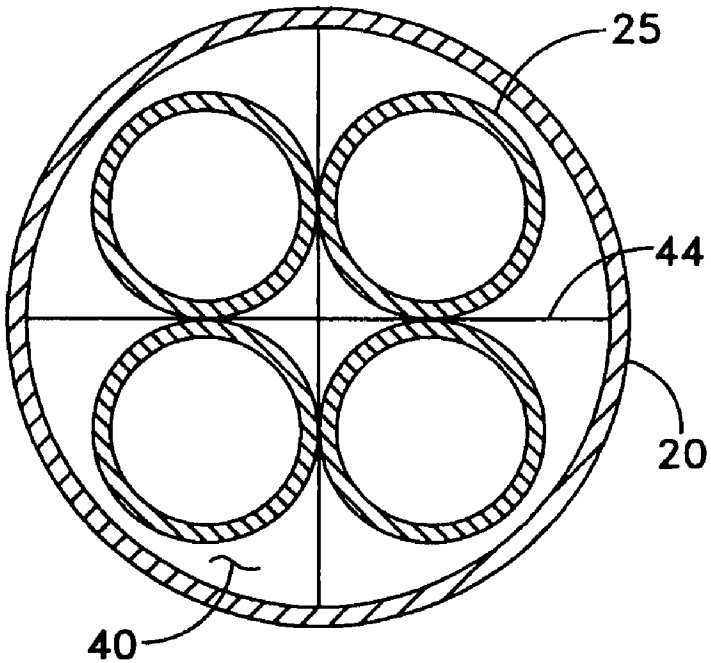
FIG. 7 is a sectional view of the canister assembly of the present invention with the view taken from reference line 7-7 of FIG. 5.
Figure 6:
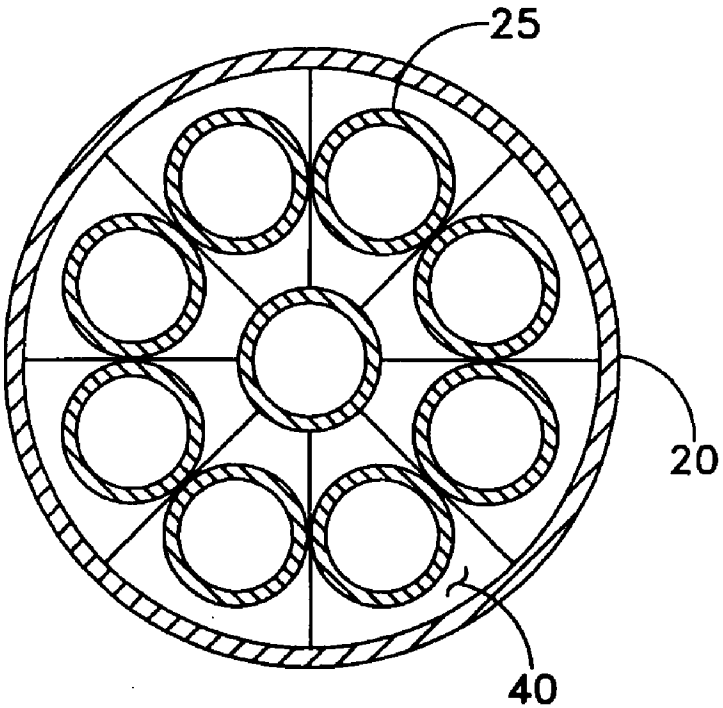
FIG. 6 is a sectional view of the canister assembly of the present invention with the view taken from reference line 6-6 of FIG. 5.

The individual deployment tubes 40 are aligned and fastened inside the canister assembly 20 by the several support frames 44 that are spaced accordingly as seen in FIGS. 6 and 7. The support frames 44 allow for flow to pass through them such that each deployment tube 40 is free flooded. If necessary, the support frames 44 could also be used to contain ballasting material that may be needed to properly weight the canister assembly 20.

The guides rails 54 are positioned along the inside diameter of the deployment tubes 40. The guide rails 54 provide for low friction support of the vehicle 25 as it travels down the deployment tube 40. The guide rails 54 also provide for an annular flow passage around the vehicle 25 to allow the vehicle to keep moving even after the spring 30 reaches its free length.

The muzzle cap 41 prevents marine life and sediment from entering the deployment tube 40 and also prevents the vehicle 25 from accidentally sliding out of the deployment tube before a launch is called for. The force retaining the muzzle cap 41 is large enough to contain the vehicle 25 during its deployment from the UUV 100, and during its descent and impact with the seafloor 200. At the same time, the force to remove the muzzle cap 41 is small enough such that the force of the spring 30 can overcome it.

The seal and constraint ring 46 is located near the forward end of the vehicle 25. The seal and constraint ring 46 provides a watertight seal during deployment. The seal and constraint ring 46 is positioned to provide a seal until the spring 30 reaches its free length. At that point the seal and constraint ring 46 will decouple from the vehicle 25 and pass over the tapered end of the vehicle. The seal and constraint ring 46 primarily prevents water from being pumped past the annular gap between the vehicle 25 and the deployment tube 40, thereby ensuring that all the water pumped by the plunger plate 45 is used to force the vehicle out of the deployment tube. The seal and constraint ring 46 also helps to stabilize the vehicle 25 inside the deployment tube 40. The seal is made from a flexible material that provides limited cushioning and sealing properties.

Figure 13:
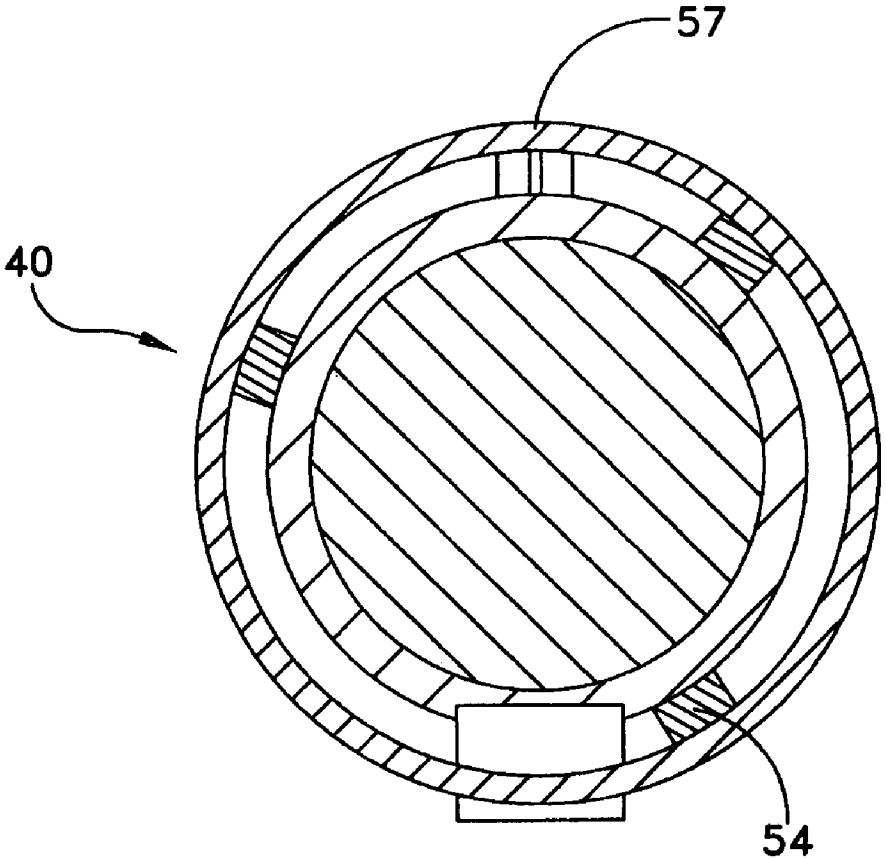
FIG. 13 is an alternate cross-sectional view of the deployment tube of the present invention specifically depicting the forward stops of the deployment tube with the view taken from reference line 13-13 of FIG. 9.

In preferred use, the head of the vehicle 25 would have a collar with a block 57 fastened upon it as seen in FIG. 13. The collar 57 is positioned on the forward end of the vehicle 25 so that when loading the vehicle into the individual deployment tube 40, the block portion would secure into a notch just forward of the constraint ring 46.

The check valve 47 and plunger plate 45 work in combination as a positive displacement pump as the spring 30 expands. As an integral piece, the plunger plate 45 and the check valve 47 are attached to an end of the spring 30.

As the spring 30 expands, it forces the plunger plate 45 towards the vehicle 25. The plunger plate 45 has a circumferential seal 58 around it to prevent water from leaking past it as the plunger plate travels along the deployment tube 40. The pressure created by the plunger plate 45 is transmitted directly to the vehicle 25 through the incompressible fluid, so as the plunger plate moves the vehicle moves. This movement continues until the spring 30 has reached the end of its free length; at that point the check valve 47 opens.

The check valve 47 allows water to fill in from behind the vehicle 25. This minimizes the amount of water that must flow back through the annular gap around the vehicle 25, thereby minimizing the fluid losses. The check valve 47 is held in place by the differential pressure across it, thereby ensuring the check valve opens as soon as the spring 30 reaches its free length. At that point, the differential pressure with the deployment tube 40 changes direction and forces the check valve 47 open.

Four sets of flow ports 32 are preferably used. One set of flow ports is located near the center of the canister assembly 20. The flow ports at the center of the canister assembly 20 allow for seawater to free flood the interior of the canister assembly; provide for a signal transmission path to the acoustic receiver 43; and act as inlet ports so seawater can be drawn in behind the plunger plate 45 as the vehicle 25 is flushed out.

A second set of the flow ports 32 are located in the individual deployment tubes 40 just forward of their respective release devices 26. These flow ports 32 allow seawater to be drawn in as the vehicles 25 are being flushed from the deployment tubes 40 as well as allowing the volume of space behind the plunger plate 45 to free flood.

A third set of flow ports 32 is located just forward of the plunger plate 45 and the check valve 46. These flow ports 32 allow the volume of space behind the vehicle 25 (aft of the ring 45) to be properly flooded.

A fourth set of flood ports 32 is located at the nose of the vehicle 25. These flow ports 32 allow the volume of space forward of the aft ring 45 to free flood.

A protective bag 60 (partially shown in FIG. 9) can be added to protect the vehicle 25 from exposure to seawater. The protective bag 60 would be filled with a non-corrosive inert fluid which would allow the body of the vehicle 25 to retain its integrity for extended durations of undersea deployment. In operation, the plunger plate 45 pushing toward the vehicle 25 would flush the volume of seawater forward and likewise impose this pressure on the protective bag 60 to tear it away thereby allowing the vehicle to exit the canister assembly 20.

All external components preferably have a reflective coating. The reflective coating of a type known to those skilled in the art provides camouflage for the system by mirroring its surroundings. In addition, the anchor plates 24 shall contain simulated seaweed that is indigenous to the area. The seaweed shall be exposed only after the anchor plates 24 are separated from the canister assembly 20. Once exposed, the seaweed will freely flow with the currents while being attached at their base to the anchor plates 24. The seaweed will help further obscure the canister assembly 20.

The deployment system 10 can be deployed covertly by a transporter such as a submarine or the large underwater UUV 100 for the covert pre-positioning of the vehicles 25 in shallow water littoral environments. Given that numerous vehicles are contained within the canister assembly 20, the canister assembly could remain as a threat against several submarines or it could release multiple vehicles against the same submarine.

The deployment system 10 also provides for long periods of on-station endurance of one year or more. This on-station deployment allows sufficient time to prepare the battle space without having to quickly replenish the pre-positioning area.

The deployment system 10 can have a reflective coating on its exterior to mirror its surroundings. This coating ensures that the canister assembly 20 will have ample camouflage in any environment. This camouflage makes it extremely difficult to visually detect the canister assembly 20 and to neutralize the canister assembly.

The anchor lines 42 in combination with the anchor plates 24 and the buoyant canister assembly 20 keeps the canister assembly positioned safely off the seafloor 200. This positioning of the seafloor 200 ensures that shifting sediment over time does not block the deployment tubes 40.

The design of the deployment system 10 is suitable for deployment from various platforms. The deployment system 10 can be deployed from submarines, surface ships, small boats, helicopters, planes, or large UUV's.

The anchor lines 42 in combination with the anchor plates 24 and the buoyant canister assembly 20 act as a shock mitigation system. Shock mitigation prevents damage to the canister assembly 20 during descent and bottom impact of the canister assembly.

It is envisioned that small UUVs would be deployed as the vehicles 25 by the deployment system 10 described. However, the deployment system 10 is not limited to deploying small UUVs. The deployment system 10 could also deploy an assortment of weapons or sensors or any other assortment of items. The items must only be able to interface with the deployment system 10. The deployment system 10 could deploy buoyant signal jamming devices, buoyant propeller fouling nets, a chemical marking plume, chemical detectors, unmanned grounds sensors, etc. Numerous uses exist for the deployment system 10.

The deployment system 10 is described throughout as being deployed from a large underwater UUV 100. However, the deployment system 10 could also be deployed from a submarine torpedo tube, an aircraft, or a surface ship. When the deployment system 10 is deployed from the large UUV 100, the quick releases 102 are actuated by a linear actuator and the spring bands 22 are released by the lanyards 104. A slight modification to these features may be necessary for some of the deployment options.

If the deployment system 10 were to be deployed from a surface ship, the quick release devices 102 would not be necessary as the entire canister assembly 20 could be tossed over the side of the surface ship. The lanyards 104 could be made longer so that the canister assembly 20 is allowed to impact the water and become fully submerged before the anchor plates 24 are released.

If the deployment system 10 were to be deployed from an aircraft, the quick release devices 102 would not be necessary. Again, the entire canister assembly 20 could be simply thrown from the aircraft. The length of the lanyards 104 could be set so that the canister assembly 20 is again allowed to impact the water and become fully submerged before the anchor plates 24 are released. If lanyards 104 are not desirable for aircraft deployment, exploding squibs could be used to release the anchor plates 24. A splash plate similar to those used when deploying torpedoes from aircraft could also be used.

The canister assembly 20 is already designed for containment inside a 21-inch diameter cylinder, which is compatible with all submarine torpedo tubes. In the submarine deployment application no quick release devices would be necessary. The canister assembly 20 could be deployed using the same weapon ejection system used for torpedoes. However, the spring bands 22 would have to be redesigned. The spring bands 22 would have to be made conformal to the outside diameter of the 21-inch diameter canister. In addition, the lanyards 104 would have to be rerouted internal through the canister assembly 20 such that they exit the aft end of the canister assembly. If not, another method such as exploding squibs would have to be used.

The canister assembly 20 can be designed with a release mechanism attached to the anchor lines 42. In this way, the canister assembly 20 can be easily recovered by merely releasing it from the anchor plates 24. Since the canister assembly 20 is buoyant, the canister assembly will ascent to the surface for easy recovery.

The deployment system 10 is described as having bi-directional launching ability. However, the deployment system 10 could easily be modified for uni-directional launches. This may be desirable if a shorter overall length for the canister assembly 20 is preferred.

In light of the above, it is therefore understood that within the scope of the appended claims, the invention may be practiced otherwise than as specifically described.

What is claimed is:

1. A deployment system for an undersea environment, said deployment system comprising:

a transporter having a quick release device and lanyards; and a canister assembly secured to said quick release device, said canister assembly having spring bands encompassing a circumference of said canister assembly and secured to said transporter by said lanyards with said canister assembly further having anchor plates secured to a first and second end of said canister assembly by at least one anchor line and said spring bands;

wherein said quick release device and said lanyards are capable of releasing said canister assembly upon deployment at an extent of said lanyards such that said spring bands separate to release said anchor plates from the ends of said canister assembly to position said anchor plates on a surface of the undersea environment thereby positioning said canister assembly by the buoyancy of said canister assembly and the securing of said at least one anchor line.

2. The deployment system in accordance with claim 1 wherein said canister assembly is capable of stowing at least one vehicle and wherein said canister assembly further comprises a signal receiver, said signal receiver operationally controllable of the vehicle such that upon detection of an acoustic signal said signal receiver initiates the release of the vehicle from said first end of said canister assembly.

3. The deployment system in accordance with claim 2, said canister assembly further comprising at least one deployment tube wherein said one least one deployment tube includes:

a release device controllable by said signal receiver;

a cord releasably secured at one end to said release device;

a plunger plate positioned transverse to a longitudinal axis of said deployment tube and secured at another end of said cord, said plunger plate movable along the longitudinal axis; and a spring positioned between said plunger plate and said release device;

wherein said signal receiver initiates the release of the vehicle from said deployment tube and said canister assembly by actuating said release device to release said cord thereby allowing said spring to uncoil with a resultant energy on said plunger plate to move against the vehicle to exit from said deployment tube and said canister assembly.

4. The deployment system in accordance with claim 3 wherein said deployment tube further includes a plurality of flow ports through a periphery of said deployment tube and wherein said plunger plate encompasses a check valve on a shared plane with said plunger plate;

wherein said flow ports are capable of drawing water from the undersea environment into said deployment tube thereby equalizing the pressure within said canister to the undersea environment in combination with the movement of said check valve; and wherein said flow ports are capable of pressuring the vehicle in combination with said plunger plate to exit said canister assembly.

5. The deployment system in accordance with claim 4 wherein said deployment tube further comprises guides rails positioned along an inside diameter of said deployment tube, said guide rails capable of providing a low friction support of the vehicle and an annular flow passage as the vehicle exits said deployment tube.

6. The deployment system in accordance with claim 5 wherein said acoustic receiver is operational to various coded release messages in order to prevent said deployment system from accidentally allowing for the release of the vehicle.

7. The deployment system in accordance with claim 6 wherein said deployment tube further comprises a protective bag to encompass the vehicle for protecting the vehicle from exposure to the undersea environment.

8. The deployment system in accordance with claim 1 wherein said canister assembly is capable of stowing a plurality of vehicles and wherein said canister assembly further comprises a signal receiver, said signal receiver operationally controllable of the vehicles such that upon detection of an acoustic signal said signal receiver can initiate the release of a vehicle from said plurality of vehicles from said first end and from said second end of said canister assembly.

9. The deployment system in accordance with claim 8, said canister assembly further comprising a plurality of deployment tubes wherein each of said plurality of deployment tubes includes:

a release device controllable by said signal receiver;

a cord releasably secured at one end to said release device;

a plunger plate positioned transverse to a longitudinal axis of said deployment tube and secured at another end of said cord, said plunger plate movable along the longitudinal axis; and a spring positioned between said plunger plate and said release device;

wherein said signal receiver initiates the release of the vehicle from said deployment tube and said canister assembly by actuating said release device to release said cord thereby allowing said spring to uncoil with a resultant energy on said plunger plate to move against the vehicle to exit from said deployment tube and said canister assembly.

10. The deployment system in accordance with claim 9 wherein said deployment tube further includes a plurality of flow ports through a periphery of said deployment tube and wherein said plunger plate encompasses a check valve on a shared plane with said plunger plate;

wherein said flow ports are capable of drawing water from the undersea environment into said deployment tube thereby equalizing the pressure within said canister to the undersea environment in combination with the movement of said check valve; and wherein said flow ports are capable of pressuring the vehicle in combination with said plunger plate to exit said canister assembly.

11. The deployment system in accordance with claim 10 wherein said deployment tube further comprises guides rails positioned along an inside diameter of said deployment tube, said guide rails capable of providing a low friction support of the vehicle and an annular flow passage as the vehicle exits said deployment tube.

12. The device in accordance with claim 11 wherein said deployment tube further comprises a protective bag to encompass the vehicle for protecting the vehicle from exposure to the undersea environment.

13. The deployment system in accordance with claim 12 wherein said acoustic receiver is operational to various coded release messages in order to prevent said deployment system from accidentally allowing for the release of the vehicle.

* * * * *